US010096193B2

(12) United States Patent
Smith

(10) Patent No.: US 10,096,193 B2
(45) Date of Patent: Oct. 9, 2018

(54) METHOD FOR DETERMINING A SORTING RESULT FOR A SECURITY DOCUMENT AND MEANS FOR CARRYING OUT THE METHOD

(71) Applicant: GIESECKE & DEVRIENT GMBH, München (DE)

(72) Inventor: Paul Smith, Obernzenn (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 98 days.

(21) Appl. No.: 15/121,628

(22) PCT Filed: Feb. 26, 2015

(86) PCT No.: PCT/EP2015/000448

§ 371 (c)(1),
(2) Date: Aug. 25, 2016

(87) PCT Pub. No.: WO2015/128089

PCT Pub. Date: Sep. 3, 2015

(65) Prior Publication Data

US 2016/0358398 A1 Dec. 8, 2016

(30) Foreign Application Priority Data

Feb. 28, 2014 (DE) ..... 10 2014 003 005

(51) Int. Cl.
*G07D 7/12* (2016.01)
*B42D 25/29* (2014.01)
*G07D 7/181* (2016.01)

(52) U.S. Cl.
CPC ..... *G07D 7/12* (2013.01); *B42D 25/29* (2014.10); *G07D 7/181* (2017.05)

(58) Field of Classification Search
CPC ..... G07D 7/12; B42D 25/29
(Continued)

(56) References Cited

U.S. PATENT DOCUMENTS 6,560,355 B2 5/2003 Graves et al.
2006/0115110 A1 * 6/2006 Rodriguez ..... B41M 3/10 382/100

(Continued)

FOREIGN PATENT DOCUMENTS

DE 102006033000 A1 1/2008

OTHER PUBLICATIONS

International Search Report from corresponding PCT Application No. PCT/EP2015/000448, dated May 28, 2015.

(Continued)

*Primary Examiner* — R. A. Smith
*Assistant Examiner* — John M Royston
(74) *Attorney, Agent, or Firm* — Workman Nydegger

(57) ABSTRACT

A method for establishing a sorting result for a value document while employing sensor data for the value document and pre-specified classification parameters, includes a pre-specified classification method carried out while employing the sensor data and the classification parameters. The method involves carrying out pre-specified substeps such that at least some of which are making a respective decision, and because of the carried out substeps a class is established as a sorting result. At least upon making the decisions at least one classification parameter associated with the respective decision and/or at least part of the sensor data and/or at least one substep result obtained upon carrying out a preceding substep is respectively employed.

17 Claims, 5 Drawing Sheets

(58) Field of Classification Search
USPC ..... 73/865.8; 340/3.7, 5.86; 382/135–140; 209/534; 700/15, 17, 27
See application file for complete search history.

(56) References Cited

U.S. PATENT DOCUMENTS

| | | | | |
|---|---|---|---|---|
| 2011/0145800 | A1 | 6/2011 | Rao et al. | |
| 2011/0283144 | A1 | 11/2011 | Nano et al. | |
| 2012/0285788 | A1 | 11/2012 | Akamatsu et al. | |
| 2015/0095937 | A1* | 4/2015 | Tobin ..... | H04N 21/2743 725/32 |

OTHER PUBLICATIONS

International Preliminary Report on Patentability from PCT Application No. PCT/EP2015/000448, dated Sep. 6, 2016.

* cited by examiner

METHOD FOR DETERMINING A SORTING RESULT FOR A SECURITY DOCUMENT AND MEANS FOR CARRYING OUT THE METHOD

BACKGROUND

The present invention relates to a method for establishing a sorting result for a value document while employing sensor data for the value document which are capturable or were captured by means of a value-document processing apparatus with one or a plurality of sensors, and while employing pre-specified classification parameters, and to means for apparatus of the method.

Value documents are understood here to be sheet-shaped objects that represent for example a monetary value and hence should not be manufacturable arbitrarily by unauthorized persons. They hence have features that are not simple to manufacture, in particular to copy, whose presence is an indication of authenticity, i.e. manufacture by an authorized body. Important examples of such value documents are coupons, vouchers, checks and in particular bank notes.

For checking such value documents by machine, value-document processing apparatuses are used. Such value-document processing apparatuses, in particular bank-note processing apparatuses, classify value documents, in particular bank notes, by means of a pre-specified classification method with regard to value-document type, in the case of bank notes with regard to currency and/or value, and/or authenticity and/or quality and/or orientation. The orientation of a value document, assuming a rectangular value document, will hereinafter be understood to be one of the four possible positions that can be obtained by rotating the value document around its longitudinal and transverse axes by 180° in each case. The quality of a value document is understood to be in particular its state; in the case of bank notes the state can be given for example by an association with classes such as "fit for circulation" and/or "unfit for circulation" and/or "damaged" or "damaged" in connection with the kind of damage. In dependence on the classification, the value documents can then for example be sorted and, where applicable, deposited in corresponding output regions. This will be explained by the example of value documents in the form of bank notes.

Classification is effected on the basis of different physical properties of the individual, i.e. respectively processed, bank note. Examples of such physical properties are optical properties, for example color properties, magnetic properties or ultrasonic properties.

Upon capture of the different physical properties of the individual, i.e. respectively yet to be processed or already processed, bank note, sensor data are generated upon processing in a bank-note processing apparatus by means of its sensors, said data being employed for the classification. The sensor data of a respective sensor describe the physical property or properties captured by the respective sensor. Sensor data will hereinafter be understood in general to be in particular raw data formed by a sensor, which are unprocessed apart from some processing operations in the sensor and/or corrections, for example also with regard to calibration and/or removal of noise components or background components.

In an attached data processing device acting as an evaluation device, which can also be configured at least partly for controlling the value-document processing apparatus or as a control and evaluation device, a classification result is established from the sensor data delivered by the sensors, by means of a classification method while evaluating the sensor data. Upon the evaluation there are determined, inter alia, bank-note features which at least partly characterize the bank-note type and/or the authenticity and/or the quality of the bank note by suitable evaluation methods in corresponding pre-specified substeps. In dependence on the determined bank-note features, the evaluation device then computes a classification result, which subsequently determines in which output pocket of the bank-note processing apparatus the bank note is to be deposited, and will hence be designated as the sorting result within the context of the present invention. When the evaluation device is configured as a control and evaluation device, it can actuate a transport device of the bank-note processing apparatus in dependence on the classification result or sorting result.

The evaluation methods and the establishment of the classification result must be adapted to the type of bank notes to be processed and also to the requirements of the operators of bank-note processing apparatuses. For this purpose, the evaluation device, preferably at least one evaluation program running therein, is parameterizable, i.e. classification parameters are present whose values are pre-specifiable and which are employed upon the carrying out of the classification method, i.e. the evaluation and actual classification, or the establishment of the classification result; said adapting of the classification parameter values, also designated as adapting of the classification parameters, in connection with the fixing of evaluation substeps and their order, where applicable, will hereinafter be designated as adaptation.

To establish appropriate classification parameters, the sensor data of corresponding, suitably pre-specified bank notes can be employed for adapting the classification parameters. More precisely, corresponding sensor data are captured and stored in a first step upon a measuring-data acquisition for the pre-specified bank notes with the bank-note processing apparatus. Said sensor data are then utilized for establishing the classification parameter values in a second step.

SUMMARY

Upon employment of a plurality of different sensors and sensors with a high resolution the classification method can become very complex, since a great number of features are established and mutually linked. Accordingly, there is a considerable number of classification parameters whose values influence the result of the classification. Upon an adaptation it is frequently not easy for a person carrying out the adaptation to recognize why a certain sorting result was obtained and which classification parameters are to be changed, where applicable.

A similar problem can arise when it is to be checked, during normal operation of a value-document processing apparatus, why a certain sorting result was established for a processed value document.

The present invention is based on the object of providing a method for establishing a sorting result for a value document wherein a classification method is employed and which allows the coming about of a sorting result to be easily understood that was obtained with the classification method employed in the establishment method while employing pre-specified classification parameters; it is a further object to provide means for carrying out said method.

The object is achieved by a method according to claim 1 and in particular a method for establishing a sorting result for a value document while employing sensor data for the value document which are capturable or were captured by means of a value-document processing apparatus with one or a plurality of sensors, and while employing pre-specified classification parameters. In the method, a pre-specified classification method is carried out while employing the sensor data and at least one of the classification parameters, upon whose carrying out pre-specified substeps are carried out, at least some of which contain the making of a respective decision, and as a result after carrying out the substeps a class is established as a sorting result, wherein at least upon the making of the decisions at least one classification parameter associated with the respective decision and/or at least part of the sensor data and/or at least one substep result that was obtained upon carrying out a preceding substep is respectively employed. In the method, for the established sorting result or the sensor data for the value document a display device is so actuated that it shows at least a section of a graph with nodes and edges respectively connecting at least two of the nodes, wherein the nodes comprise a starting node, at least one substep node representing a substep necessary for obtaining the sorting result, and at least one result node representing a possible sorting result, and the edges so connect the nodes that, together with the nodes connected thereby, they form a sequence, given by the classification method, of substeps represented by the nodes, and wherein those edges are marked that form a continuous path from the starting node to the result node representing the sorting result, said path representing the run of the classification method for the sensor data, and/or wherein as edges only those edges are shown that form a continuous path from the starting node to the result node representing the sorting result, said path representing the run of the classification method for the sensor data, and/or wherein those nodes are marked that are directly connected by edges that form a continuous path from the starting node to the result node representing the sorting result, said path representing the run of the classification method for the sensor data.

The method according to the invention can be executed by means of a data processing device which actuates the display device. The object is hence further achieved by a computer program with program code upon whose execution by means of a data processing device which actuates a display device a method according to the invention is executed. Further subject matter of the present invention is a physical data carrier on which a computer program according to the invention is stored.

The object is further achieved by a system for establishing a sorting result for a value document while employing sensor data for the value document which are capturable or were captured by means of a value-document processing apparatus with one or a plurality of sensors, and while employing pre-specified classification parameters, having a data processing apparatus and having a display device, wherein the data processing device comprises at least one processor and a storage in which a computer program according to the invention is stored which is executable by means of the data processing device, wherein the at least one processor actuates the display device. The data processing device executes the program while employing the at least one processor which also actuates the display device directly or by means of at least one interposed graphics processor. The data processing device can in particular possess one or a plurality of processors which have one or a plurality of cores.

According to a preferred embodiment, the system, in particular the data processing device, can be a system separate from a value-document processing apparatus by means of which the sensor data are captured.

According to another preferred embodiment, the method according to the invention can be carried out by means of a value-document processing apparatus which comprises the display device. The system according to the invention can then be part of an apparatus for processing value documents. The subject matter of the present invention is hence also an apparatus for processing value documents having a feeding device for feeding single or singled value documents to be processed, an output device having at least one output portion for receiving processed value documents, a transport device for transporting single or singled value documents from the feeding device to the output device, a sensor device for capturing sensor data for a value document transported by the transport device, and a system according to the invention for establishing a sorting result for processing the captured sensor data which is connected to the sensor device via a signal connection. Preferably, at least the data processing device, preferably the system, also acts in certain operating modes as a control and evaluation device which actuates the transport device. In this embodiment, the method according to the invention can in particular also be effected after completion of the processing, for example sorting, of value documents and on the basis of sensor data that were captured and stored upon the previous processing of value documents.

In the method, there is employed a pre-specified classification method which requires as input data the sensor data and the pre-specified classification parameters. The classification parameters are adaptable, but are firmly pre-specified for the duration of the respective execution of the classification method and preferably stored in a storage of the data processing device. The classification method is likewise pre-specified and preferably capable of being carried out on the value-document processing apparatus.

The classification method comprises a plurality of substeps in which a result is respectively established and/or a decision made. If a classification parameter is employed in a substep in which only a result is established, it suffices for said parameter to enter into the establishment of the result, without a decision needing to be immediately involved. For example, in such a substep a value for a feature of the value document can be established as a result from sensor data and/or from a result of another substep, which value can then be employed in following substeps. The value-document feature can in this connection describe in particular a pre-specified property of the value document. The value-document feature can in particular be relevant for the establishment of the classification result. Preferably, process data are stored during the carrying out of the classification method, which describe which of the substeps were carried out, preferably with which result or which decision.

For easier analysis of the classification, the invention provides that the display device, for example a monitor, is so actuated, preferably in dependence on the stored process data, that it displays at least a section of a directed graph. For this purpose, the data processing device can, while employing the process data, generate corresponding display data which are employed for actuating the display device. The graph serves to illustrate possible runs of the classification and/or the run of the classification, i.e. the sequence of the substeps, for the given sensor data. Each substep can have associated therewith in the graph a node which represents the substep. The graph further possesses edges, each one of which interconnects at least two nodes. The edges are so pre-specified that they so connect the nodes that, together with the nodes connected thereby, they represent a sequence, given by the classification method, of substeps represented by the nodes. In particular, an edge can respectively connect two nodes which represent substeps of which a second one of the substeps is executed after the other, first substep according to the pre-specified classification method, and that the edge is directed from the node representing the first one of the substeps to the node representing the second one of the substeps; this is in particular the case when the second substep employs the result of the first substep and can only be executed when the result of the first substep is known. This means that there can be for example at least two branches in the graph that begin at the same node and end at the same node, wherein the substeps represented by the nodes in one branch can be executed independently of the substeps represented by the nodes of the other branch; in particular, they can be carried out at least partly in parallel.

The run of the classification method for the concrete sensor data for the value document is represented by a path in the graph that leads from the starting node to the result node representing the sorting result. It is formed by nodes that are connected by edges and represent substeps carried out upon the carrying out of the classification method, and the corresponding node-connecting edges. For representing the run of the classification method for the concrete sensor data for a value document, three possibilities are proposed which can be employed alternatively or jointly.

Thus, those edges can be marked that form the continuous path from the starting node to the result node representing the sorting result, said path representing the run of the classification method for the sensor data. In this case, the display device can also additionally be so actuated that other nodes and edges are shown that represent substeps that would be executed upon the carrying out of the classification method for other sensor data. This enables an overview of the possible variants of run upon the carrying out of the classification method.

However, there can also be shown as edges only those edges that form the continuous path from the starting node to the result node representing the sorting result, said path representing the run of the classification method for the sensor data. In this connection, all nodes or only the nodes connected by the edges can be displayed, depending on the embodiment. This representation is characterized in that it only illustrates the absolutely necessary information and is hence especially clear.

Further, those nodes can be marked that are directly connected by edges that form a continuous path from the starting node to the result node representing the sorting result, said path representing the run of the classification method for the sensor data. A good overview of the possible variants of run of the classification method can also result in this case.

In the method, it is preferred that the display device is so actuated that at least the classification parameters employed for establishing the sorting result are displayed, wherein the classification parameters employed upon the execution of the substep corresponding to the node are preferably displayed at the nodes of the path. This representation advantageously enables the user to obtain a quick overview of the dependences of the respective result of the substep on the classification parameters.

Further, it is preferred that the display device is so actuated that adjacent to at least one of the substep nodes the result of the carrying out of the substep represented by the substep node is displayed.

The marking of the edges and/or nodes can be effected in different ways, whereby the hereinafter described embodiment alternatives can be used alone or else in combination.

According to one embodiment, it is preferred that, in the method, the display device is so actuated that the marked edges or the marked nodes are marked in color. If the color is selected accordingly, an especially striking representation of the path can be attained.

According to another embodiment, it is preferred that, in the method, the display device is so actuated that there are displayed marked edges with a pre-specified line shape which differs from the line shape employed for displaying other edges or from the line shapes employed for displaying other edges. This embodiment, in particular in combination with the embodiment described in the preceding paragraph, allows an especially distinct highlighting of the path.

Further, in the method, there can preferably be displayed only those nodes that lie in the continuous path. This variant also increases the clarity of the representation.

Further, it is preferred that the result of the substep is displayed at least at nodes representing a substep in which only a result is established but no decision made. This allows very detailed tracking of the method run.

According to a further embodiment, it is preferred that the display device is so actuated that the display is updated after the carrying out of one substep in each case or of a pre-specified number of substeps in each case, so that the part of the path is represented that corresponds to the hitherto carried out substeps, wherein the mode of display of the part of the path preferably corresponds to the mode of display of the path. For this purpose, the execution of the classification method can respectively be interrupted, preferably by means of the data processing device, after the execution of the respective substep or of the pre-specified number by substeps until an input of a user via an input device, preferably connected to the data processing device or contained therein, is captured.

Further, it is preferred that, in the method, for each substep in which a classification parameter is employed the employed classification parameter is stored in a storage device. This enables a later employment of the classification parameters.

This embodiment is particularly preferred when it is combined with the embodiment of the method in which after termination of the classification method for the sensor data for the value document at least one user input is captured, and when the latter represents a value for one of the classification parameters said value for the classification parameter is stored, and the classification method with the then present or stored classification parameters, and the actuating of the display device, are carried out. This enables an interactive fixing of classification parameters.

To enable the run of the classification method to be reconstructed later, for at least one of the carried out substeps the data employed upon its carrying out can preferably be stored in a storage device.

BRIEF DESCRIPTION OF THE DRAWINGS

The invention will hereinafter be explained further by way of example with reference to the drawings. There are shown.

DETAILED DESCRIPTION OF VARIOUS EMBODIMENTS

Figure 1:
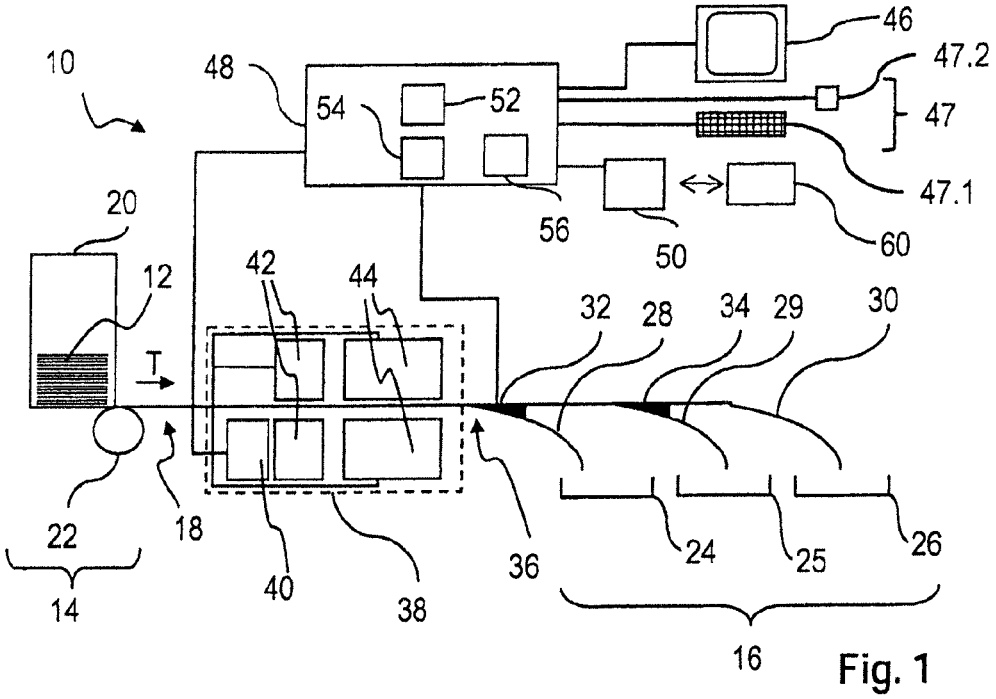
FIG. 1 a schematic view of a value-document processing apparatus in the form of a bank-note sorting apparatus.

A value-document processing apparatus 10 in FIG. 1, in this example an apparatus for processing value documents 12 in the form of bank notes, is configured for sorting value documents in dependence on the recognition of the authenticity and the state of processed value documents. The hereinafter described components of the apparatus are arranged in a housing (not shown) of the apparatus or held on said housing, unless they are designated as external.

The apparatus has a feeding device 14 for feeding value documents, an output device 16 for receiving processed, i.e. sorted, value documents, and a transport device 18 for transporting singled value documents from the feeding device 14 to the output device 16.

The feeding device 14 comprises, in this example, an input pocket 20 for a value-document stack and a singler 22 for singling value documents out of the value-document stack in the input pocket 20 and for feeding the singled value documents to the transport device 18.

The output device 16 comprises, in this example, three output portions 24, 25 and 26 into which processed value documents can be sorted, being sorted according to the result of the processing. In this example, each of the portions comprises a stack pocket and a stacking wheel (not shown) by means of which fed value documents can be deposited in the stack pocket.

The transport device 18 has at least two, in this example three, branches 28, 29 and 30 at whose ends one of the output portions 24, 25, 26 is arranged in each case, and, at the branching points, gates 32 and 34, controllable by positioning signals, by means of which value documents are feedable to the branches 28 to 30 and thus to the output portions 24 to 26 in dependence on positioning signals.

At a transport path 36, defined by the transport device 18, between the feeding device 14, in this example more precisely the singler 22, and the first gate 32 after the singler 22 in the transport direction is arranged a sensor device 38 which measures physical properties of value documents while the value documents are being transported past and forms sensor signals rendering the measuring results. In this example, the sensor device 38 has three sensors, namely, an optical remission sensor 40 which captures a remission color image and a remission IR image of the value document, an optical transmission sensor 42 which captures a transmission color image and a transmission IR image of the value document, and a transmission ultrasonic sensor 44 which captures or measures ultrasound transmission properties of the value document in a spatially resolved manner and will hereinafter only be designated as an ultrasonic sensor for simplicity's sake. The sensor signals formed by the sensors correspond to sensor data or raw data of the sensors which, depending on the sensor, may have already been subjected to correction, for example in dependence on calibrating data and/or noise properties.

For capturing and displaying operator control data, the value-document processing apparatus 10 has an input/output device. The latter comprises in this embodiment example a display device 46, for example an LCD display, and for input as an input device 47 a keyboard 47.1 and a pointing device 47.2, for example a mouse. In other embodiment examples, it can be realized for example by a touch-sensitive display device ("touch screen").

A data processing device 48 serves as a control and evaluation device 48. It is connected via signal connections to the sensor device 38, the display device 46, the input device with keyboard 47 and pointing device 47' and the transport device 18, in particular the gates 32 and 34. Further, a data interface 50 is connected to the data processing device or control and evaluation device 48, by means of which the control and evaluation device 48 can read data sets from an external device. In the present example, the data interface 50 has a USB interface with a USB connection via which data can be read from an external storage device 60, in the example a USB storage medium, and/or be written thereto. The data processing device 46 with the display device 48 and the input device 47 with keyboard 47.1 and pointing device 47.2 forms a system for establishing a sorting result for a value document while employing sensor data for the value document which are capturable or were captured by means of a value-document processing apparatus with one or a plurality of sensors, and while employing pre-specified classification parameters.

For evaluating the sensor data and controlling the devices of the apparatus, the control and evaluation device or data processing device 48 has in particular—besides corresponding data interfaces (not shown in the figures) for the sensor device 38 or its sensors—a processor 52 and, connected to the processor 52, a storage 54 in which is stored at least one computer program with program code upon whose execution the processor 52 controls the apparatus.

The value-document processing apparatus 10 further has a measuring-data storage 56 connected to the processor 52, in which can be stored, inter alia, sensor data that were captured for processed value documents. The measuring-data storage 56 can be part of the control and evaluation device 48, as represented in FIG. 1, or be separate therefrom. In this embodiment example, said measuring-data storage is a non-volatile storage, for example a hard disk.

Further, the control and evaluation device, i.e. data processing device, 48 actuates the input/output device 46 to display operator-control data, inter alia, and captures via said device operator-control data which correspond to an operator's inputs.

The value-document processing apparatus 10 is configured for being operated in two operating modes, a sorting mode for sorting value documents in dependence on their state or quality and their authenticity, and an analysis mode in which a sorting result can be established from sensor data that were captured for a value document and stored, and the coming about of said sorting result can be checked. The data processing device or control and evaluation device 48 and in particular the computer program therein is configured accordingly for this purpose.

In the sorting mode, value documents are singled out of the feeding device and transported past the sensor device 38 or therethrough. The sensor device 38 captures or measures physical properties of the value document respectively transported past or through it and forms sensor signals or sensor data which describe the measurement values for the physical properties. The control and evaluation device 48 carries out a pre-specified classification method, wherein a class representing a sorting result, depending on what is pre-specified one of pre-specified state classes and/or authenticity classes, is established in dependence on the sensor data of the sensor device 38 for a value document and on classification parameters for the value document that are stored in the evaluation device. In dependence on the sorting result, it actuates by emitting positioning signals the transport device 18, here more precisely the gates 32 or 34, such that the value document is outputted, in accordance with its class established upon the classification or the established sorting result, into an output portion of the output device 16, said portion being associated with the class or sorting result. An identifier of the value document, given for example by the stack pocket and the position of the value document in a stack therein, the sensor data, the classification parameters and the sorting result for the value document are respectively stored in the measuring-data storage 56.

In the analysis mode, it can be reconstructed, employing a method for establishing a sorting result for sensor data for a value document which are stored in the measuring-data storage 56, which sorting result can be obtained with the classification method employed in the value-document processing apparatus while employing the classification parameters stored in the measuring-data storage for the value document, and how said result comes about.

For this purpose, there is stored in the data processing device 48, more precisely in its storage 52, a computer program upon whose execution by the processor 52 the hereinafter described embodiment example of a method for establishing a sorting result for a value document is executed.

This method involves, inter alia, carrying out a classification method as is also carried out by the value-document processing apparatus 10 in the sorting mode. In so doing, the run of the classification method is represented schematically on the display device 46 in the hereinafter described way.

The classification method comprises, inter alia, a number of substeps, not all of which need to be executed, this depending on the employed classification parameters and the employed sensor data. In said substeps, results are established or decisions made. This is done in dependence on at least part of the sensor data and/or at least one result of a previously carried out substep and/or at least one classification parameter. Insofar as results are established, they may in particular involve value-document features that describe pre-specified properties of the value document for which the sensor data are captured. Said value-document features or their values or manifestations can influence the run of the classification method.

In general, a classification method for a value-document processing apparatus as described hereinabove comprises a plurality of substeps and is quite complex. For simplicity's sake, a strongly simplified classification method will be assumed hereinafter, in which there is only a sorting only with regard to the state of the value document and hence only the classes "reject", "fit" (for circulation) and "unfit" (for circulation) are employed as sorting results.

Further, it will be assumed that only value documents of two value-document types can be classified with regard to their state, namely, those of the value-document type "type 1" and of the value-document type "type 2".

For the sake of simpler representation, it will further be assumed that only the following substeps are provided for a representation on the display device.

In a substep T1 it is established whether sensor data for a value document that overlaps with at least one further value document were established. Such constellations can result when two adjacent value documents are not, or not completely, separated upon singling of the value documents. They are also designated as "multiple picks". In the present embodiment example, sensor data of the ultrasound transmission sensor are employed for this purpose. A multiple pick is therefore recognized when the transmission resulting from the ultrasonic sensor data is smaller than a pre-specified limiting value SW1, which represents an adaptable classification parameter of the classification method. The substep thus represents a decision with the result "yes" or "no" which depends on the classification parameter SW1 and the sensor data of the ultrasonic sensor.

A further substep T2 is the decision of whether the value document has the value-document type "type 1" according to the sensor data. For this purpose, the sensor data of the remission sensor are employed in this embodiment example. In the remission image a search is done for pre-specified features for value documents of the type "type 1". If more than N2 features are found, it is decided that the value document has the type "type 1", otherwise it does not. The value of N2 is likewise a classification parameter of the classification method. Further, this substep yields a result for the value document's value-document type which can be employed in the following substeps.

A substep T3 is the decision of whether the value document has the value-document type "type 2" according to the sensor data. For this purpose, the sensor data of the remission sensor are employed in this embodiment example, as in step T2. In the remission image a search is done for pre-specified features for value documents of the type "type 2". If more than N3 features are found, it is decided that the value document has the type "type 2", otherwise it does not. The value of N3 is likewise a classification parameter of the classification method. Further, this substep yields a result for the value document's value-document type which can be employed in the following substeps.

The substeps T4 to 6 relate, in the present embodiment example, to checks of whether defects are present that exclude further circulation. The presence of the respective defect leads to the result "YES", otherwise the result "NO" is established.

A substep T4 relates to the decision of whether an adhesive strip is present on the value document according to the sensor data. For this purpose, the sensor data of the ultrasonic sensor are employed again. It is checked whether the sensor data of the ultrasonic sensor for a strip-shaped region yield an ultrasound transmission that undershoots a pre-specified threshold value SW4. If this is the case, the presence of an adhesive strip is assumed. The result of the substep T4 is thus the result "YES" if an adhesive strip is present, and otherwise "NO".

A substep T5 relates to the decision of whether the value document is limp according to the sensor data. For this purpose, the sensor data of the ultrasonic sensor are employed. Summing up roughly, it is checked whether the variance of the ultrasound transmission for locations on the value document exceeds a pre-specified limiting value SW5. Said limiting value also represents a classification parameter. Establishing limpness by employing ultrasound data is described in DE 10 2006 03300 A1, paragraphs [0095] to [0102], whose relevant content is incorporated in this description by reference. The result of the substep T5 is thus the result "YES" if the limiting value is exceeded and the presence of "limpness" is recognized, and otherwise "NO".

A substep T6 relates to the decision of whether the value document is too strongly soiled. For this purpose, the sensor data of the optical remission sensor, more precisely a digital colored image, the sensor data of the optical transmission sensor and the established value-document type are employed. For this purpose, the number of soiling pixels is established; soiling pixels are those pixels of the digital image for which the color or color coordinates resulting from the remission image for the respective pixel of the value document differ by more than a pre-specified distance Δ according to a pre-specified criterion from color coordinates pre-specified for the pixel and the value-document type. If the number exceeds a limiting value N6, an excessive soiling is assumed and the result is a "YES" upon the presence of a soiling, otherwise a "NO".

The substeps are not carried out in an arbitrary order. The possible orders are determined by the classification method, and the concrete order for sensor data for a concrete value document by the classification method, the sensor data and the classification parameters. This will be described more precisely hereinafter.

Figure 2:
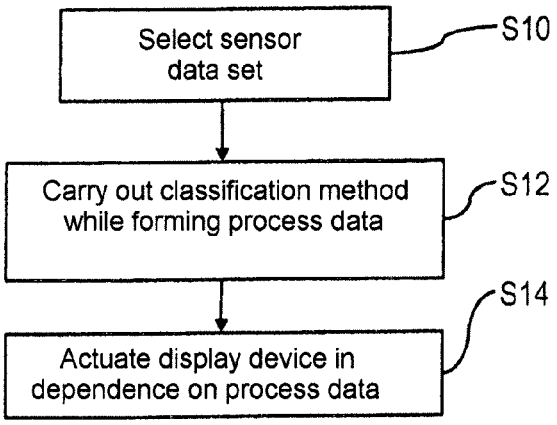
FIG. 2 a simplified flowchart of a first embodiment example of a method for establishing a sorting result that can be carried out by means of the apparatus in FIG. 1, FIG. 3 a display on a display device of the apparatus in FIG. 1 upon execution of the method in FIG. 2, FIG. 4 a display on a display device of the apparatus in FIG. 1 upon execution of a second embodiment example of a method for establishing a sorting result that can be carried out by means of the apparatus in FIG. 1, FIG. 5 a display on a display device of the apparatus in FIG. 1 upon execution of a third embodiment example of a method for establishing a sorting result that can be carried out by means of the apparatus in FIG. 1, FIG. 6 a simplified flowchart of a fourth embodiment example of a method for establishing a sorting result that can be carried out by means of the apparatus in FIG. 1, and FIG. 7 a block representation of an embodiment example of a system for establishing a sorting result for a value document.

An embodiment example for establishing a sorting result will be described hereinafter with reference to FIGS. 2 and 3. FIG. 2 shows a rough flowchart of the method.

First, the data processing device 48 so actuates the display device 46 in step S10 that it displays an input field in which a user can input an identifier of the value document as is stored in association with the sensor data. The identifier identifies a value document for which sensor data are stored in the measurement-value storage 56. It then captures signals of the input device 47 or 47.1, 47.2 which represent an identifier inputted by the user.

In the step S12, the data processing device 48 then executes the classification method with the sensor data and classification parameters stored for the value document in the mass storage 56, and establishes the corresponding sorting result. Upon the execution of the classification method it stores process data describing which of the substeps were carried out with which result or which decision.

In step S14, the data processing device 48 actuates the display device 46 to display, in dependence on the established process data, a graph which represents the carried out classification method. The display or representation of the graph on the display device 46 is shown in FIG. 3.

The graph is determined by the employed classification method. It has nodes and edges which respectively connect two nodes. The nodes comprise a starting node, substep nodes and result nodes representing a possible sorting result. The starting node A represents the starting point of the classification by means of the classification method. The result nodes $Z_1$, $Z_2$, $Z_3$ respectively represent the end of the carrying out of the classification method and the possible sorting results "reject", "unfit" and "fit".

The substep nodes T1, T2, . . . , T6 are marked by reference signs which are also the designations of the substeps which they represent and which are described hereinabove. The nodes can also be represented solely by text in other embodiment examples.

Further, the graph has edges which so connect nodes that, together with the nodes connected thereby, they represent a sequence, given by the classification method, of substeps represented by the nodes. This means that not every node is connected to every other node, but rather the presence of an edge between two nodes is determined by the classification method. In FIG. 3, for clarity's sake, a reference sign K is shown for only one edge.

In this example, there emanates from the starting node A only one edge which leads to the substep T1, since at the beginning of the classification method it is always checked whether a multiple pick is present. Since the substep T1 represents a decision, at least two edges emanate from the node representing it. One edge leads directly to the result node $Z_1$ "reject", since upon ascertainment of a multiple pick no other classification is reasonably possible. The other edge, that of the decision that no multiple pick is present, leads to the substep node T2. The classification method does not provide for any other possibilities of executing the method after execution of the substep T1.

Proceeding from the substep T2 in which it is checked whether the value document has the value-document type "type 1", two substeps can be carried out. If the value-document type "type 1" was not recognized, the substep T3 can be carried out, on the one hand. Hence, an edge connects the corresponding nodes T2 and T3. If the value-document type "type 1" is recognized, however, the substep T4 is first executed. Accordingly, an edge connects the nodes T2 and T4. Proceeding from substep T2 the classification method provides for no further variants of the embodiment, so that no further edges are present besides the above-described edges for T3 and T4.

The same applies to the substep T3 except for the sole difference that if the value-document type "type 2" might not be recognized either, the method is terminated with the sorting result "reject", so that a corresponding edge is shown.

Each of the steps T4 to T6 can lead to the results that the respective defect is present and the result is a "YES" or the defect is not present and the result is a "NO". The method is so designed that at the first occurrence of a result "YES" the decision "unfit" is made. Hence, edges respectively lead from the region of said three substep nodes that corresponds to the result "NO" to the result node $Z_2$ which represents the result "unfit". If a "NO" is established as a result in one of the substeps T4 and T5, i.e. no sufficient defect was found, the method is continued with the next substep T5 or T6. If a "NO" is also established in T6, the sorting result "fit" is established, so that an edge leads from the region of the substep node T6 that corresponds to the result "NO" to the result node $Z_3$.

Since the classification method provides for no other possibilities, edges lead from said substep nodes only to the substep node T7 which corresponds to the substep T7 in which it is decided in dependence on the results of the substeps T4 to T6 whether the sorting result is "fit" or "unfit". Accordingly, two edges emanate from the substep node T7 and lead to the corresponding result nodes $Z_2$ and $Z_3$.

Adjacent to the substep nodes of substeps in which classification parameters are employed there are respectively represented classification-parameter fields $P_1, \ldots, P_6$, in which the classification parameters respectively employed in the substep are shown with their values. The designation of the classification parameters corresponds to the hereinabove employed designation.

Further, adjacent to the substep nodes T4, T5 and T6, in this example at pre-specified edges, there are represented result fields $E_4$ to $E_6$, in which the upon the carrying out of the corresponding carried out substep show.

For representing the nodes, edges, classification-parameter fields and result fields, corresponding data which are associated with the classification method are stored in the computer program or a corresponding configuration file. Upon a change of the classification method, said data must be adapted, where applicable. In particular, in the present embodiment example, standard colors and standard shapes are pre-specified for nodes, and standard colors and standard stroke widths for the edges. Further, the computer program or configuration file has stored therein configuration data which represent a special color for traversed nodes and special stroke widths for traversed edges.

For actuating the display device, the data processing device 48 employs the process data established upon the execution of the classification method, which describe which of the substeps were carried out with which result or which decision. It establishes, in dependence on the method data and the classification parameters, display data which at least partly define the representation to be displayed or the graph to be displayed, and so actuates the display device in accordance with the display data that the above-described graph is represented. In so doing, however, the edges forming a continuous path from the starting node to the result node representing the sorting result, said path representing the run of the classification method for the sensor data, are marked by the special stroke width, which is greater than the stroke width for representing the other edges. Said edges are uniquely described by the data describing which of the substeps were carried out with which result or which decision. Further, those nodes are specially marked by representation in the special color that are directly connected by edges which form a continuous path from the starting node to the result node representing the sorting result, said path representing the run of the classification method for the sensor data. Said nodes represent the carried out substeps. This is represented in FIG. 3 by a dotted background. Said nodes are also uniquely described by the process data describing which of the substeps were carried out with which result or which decision.

Figure 3:
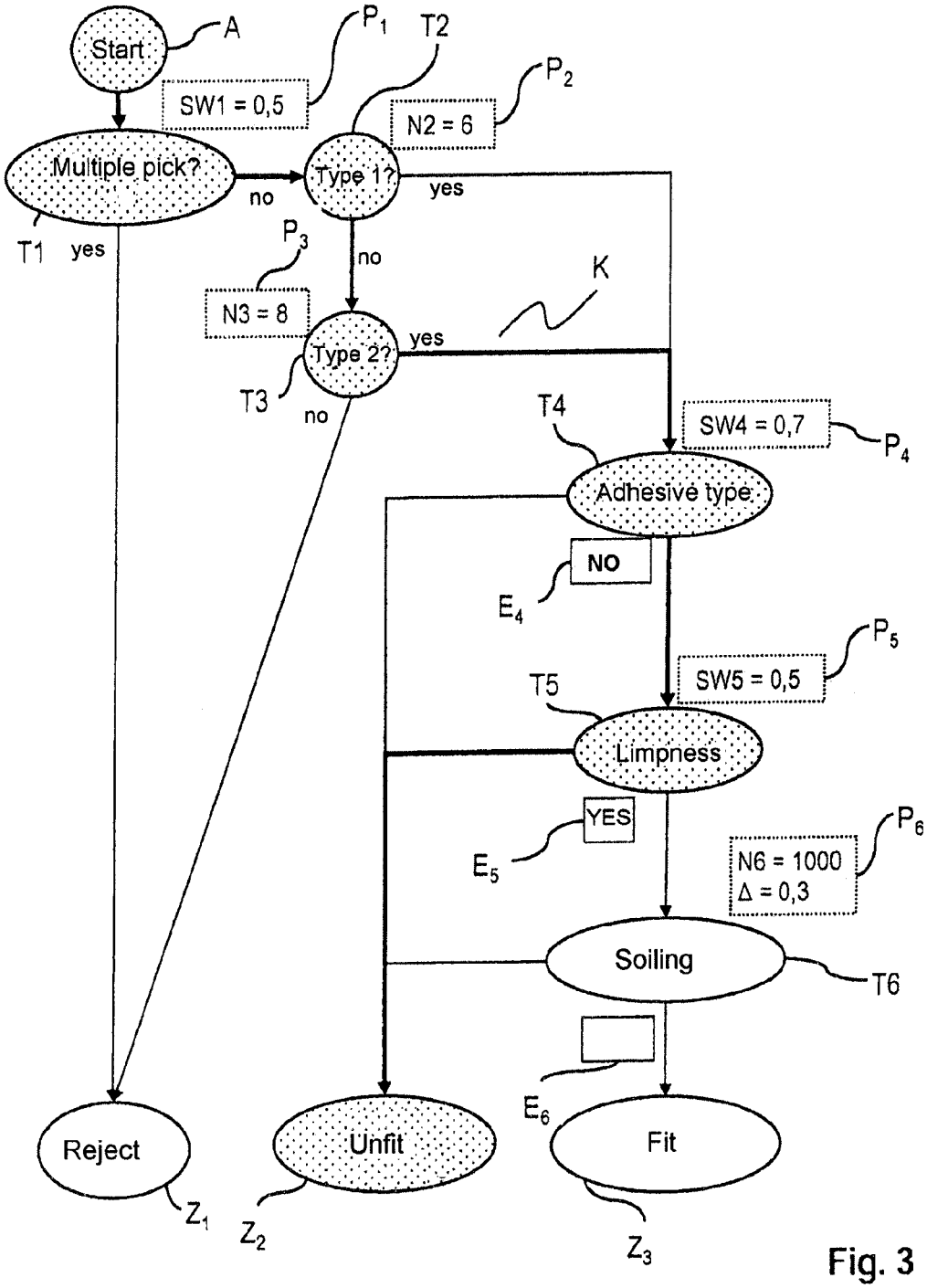

FIG. 3 shows the case that a sorting result is, or was, established for sensor data for a value document of the value-document type "type 2". Since no multiple pick is present, the substeps T1, T2, T3, T4 and T5 are first passed through. In T5 an excessive limpness and thus the result "YES" is established. This leads immediately to the result "unfit", marked by the result node $Z_2$. The substep T6 is no longer executed; accordingly the result field $E_6$ remains empty. The path through the graph hence passes from A through T1 to T5 up to $Z_2$. At first glance it can be recognized that the result is due to excessive limpness.

In this manner the coming about of the sorting result can be easily reconstructed.

In a further step, the data processing device 48 can store the data describing the graphics after capturing a corresponding input signal in consequence of a user's input by means of the input device 47 or 47.1, 47.2.

If the value document had had the value-document type "type 1", the sequence of the substeps would be T1, T2, T4, etc. Then the edge between T1 and T2 would be highlighted, as in the case of FIG. 3, and the edge between T2 and T4. Further, the node corresponding to the substep T3 would not be marked by a dotted background.

Figure 4:
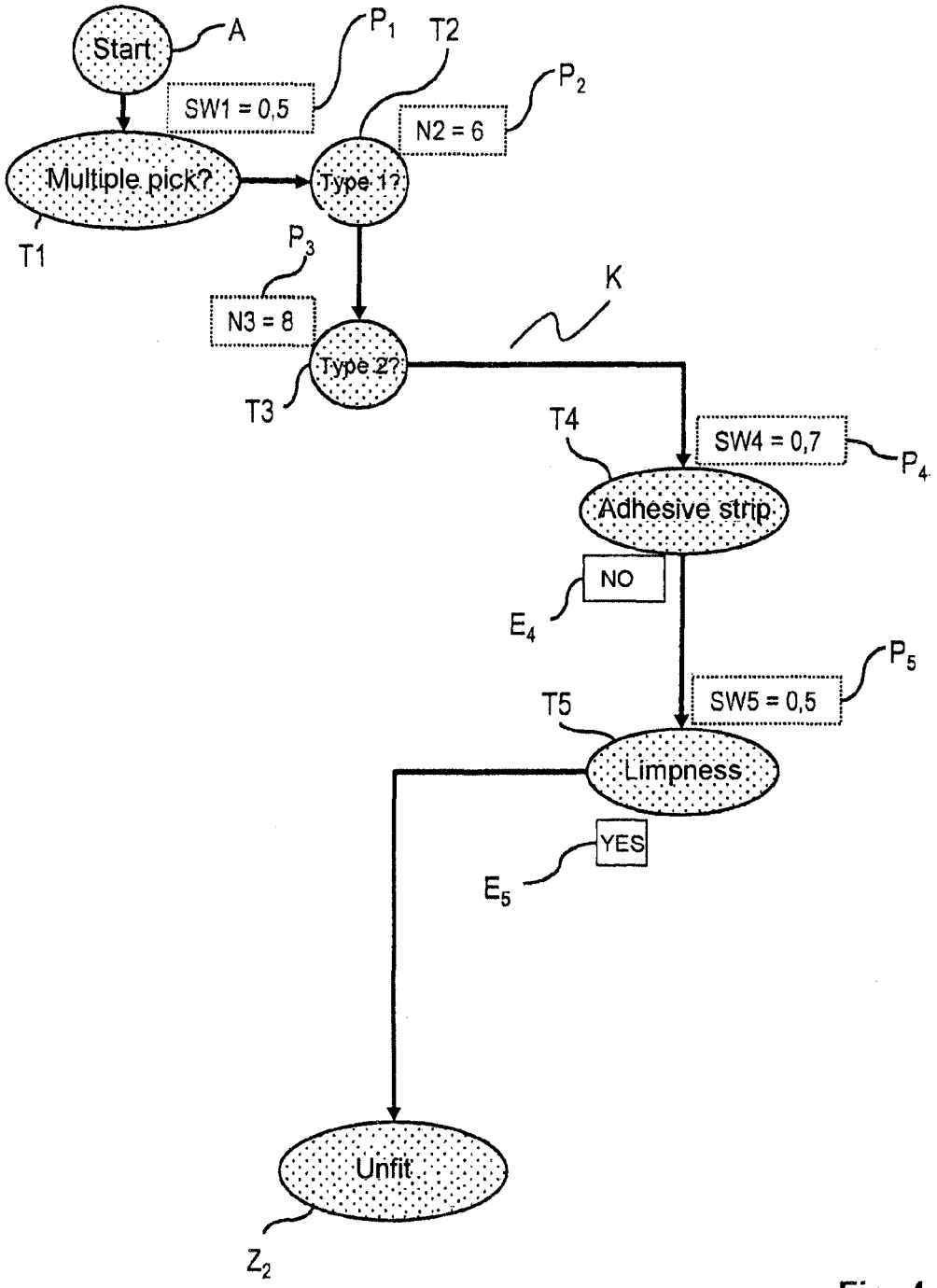

A second embodiment example differs from the first embodiment example only in that the actuation of the display device is modified to the effect that only the starting node, the substep nodes corresponding to carried out substeps, and the result node are shown in order to increase clarity. The display for the same sensor data and classification parameters as underlie FIG. 3 are employed here, too, resulting in the representation shown in FIG. 4.

A third embodiment example for a method for establishing a sorting result differs from the first embodiment example in that the steps T4 to T6 are replaced by steps T4' to T6', and an additional step T7' is executed. An example of a display generated upon execution of the method is represented schematically in FIG. 5.

The step T4' differs from the step T4 solely in that not "YES" or "NO" is established as the result of the check for the presence of adhesive strips, but rather a recognized area of an adhesive strip based on the area of the value document. Since no decision is made on the basis of which the further processing might be effected differently, only one edge leads out of the corresponding node.

The step T5' differs from the step T5 solely in that no comparison with a threshold value is performed and "YES" or "NO" established as a result, but rather the value is stored for later employment, which value is compared with the threshold value in step T5. Since no decision is made on the basis of which the further processing might be effected differently, only one edge leads out of the corresponding node here, too.

The step T6 ' differs from the step T6 solely in that a comparison with the limiting value N6 is no longer carried out and "YES" or "NO" is not established as a result. Instead, the result established is the quotient of the number of soiling pixels and the number of pixels of the digital image of the value document as a result of the substep. Here, too, only one edge leads out of the node, since no decision is made on the basis of which the further processing might be effected differently.

Accordingly, the result fields $E_4$ to $E_6$ are replaced by the result fields $E_4'$ to $E_6'$ in which the described results of the respective substeps are respectively represented.

In the step T7' an overall result for the state is established, by the results of the steps T4' to T6' being multiplied by classification parameters A4, A5 and A6 and added. The sum is then compared with a threshold value SW7' which likewise represents a classification parameter. If the sum exceeds the threshold value, it is decided that the class "unfit" is established as a sorting result, otherwise the class "fit". Accordingly, edges lead from the node representing the substep T7' to the corresponding result nodes.

In accordance with the changed classification parameters, the classification-parameter field $P_5$ is absent and the classification-parameter fields $P_4$ and $P_6$ are replaced by classification-parameter fields $P_4'$ and $P_6'$. Further, a classification-parameter field $P_7'$ is displayed, in which the classification parameters employed in step T7' are shown.

As in the first embodiment example, the starting node A, the nodes corresponding to the carried out substeps, and the result node corresponding to the sorting result are marked by dotting, and the corresponding path or route by the increased stroke width of the edges connecting the nodes.

Figure 5:
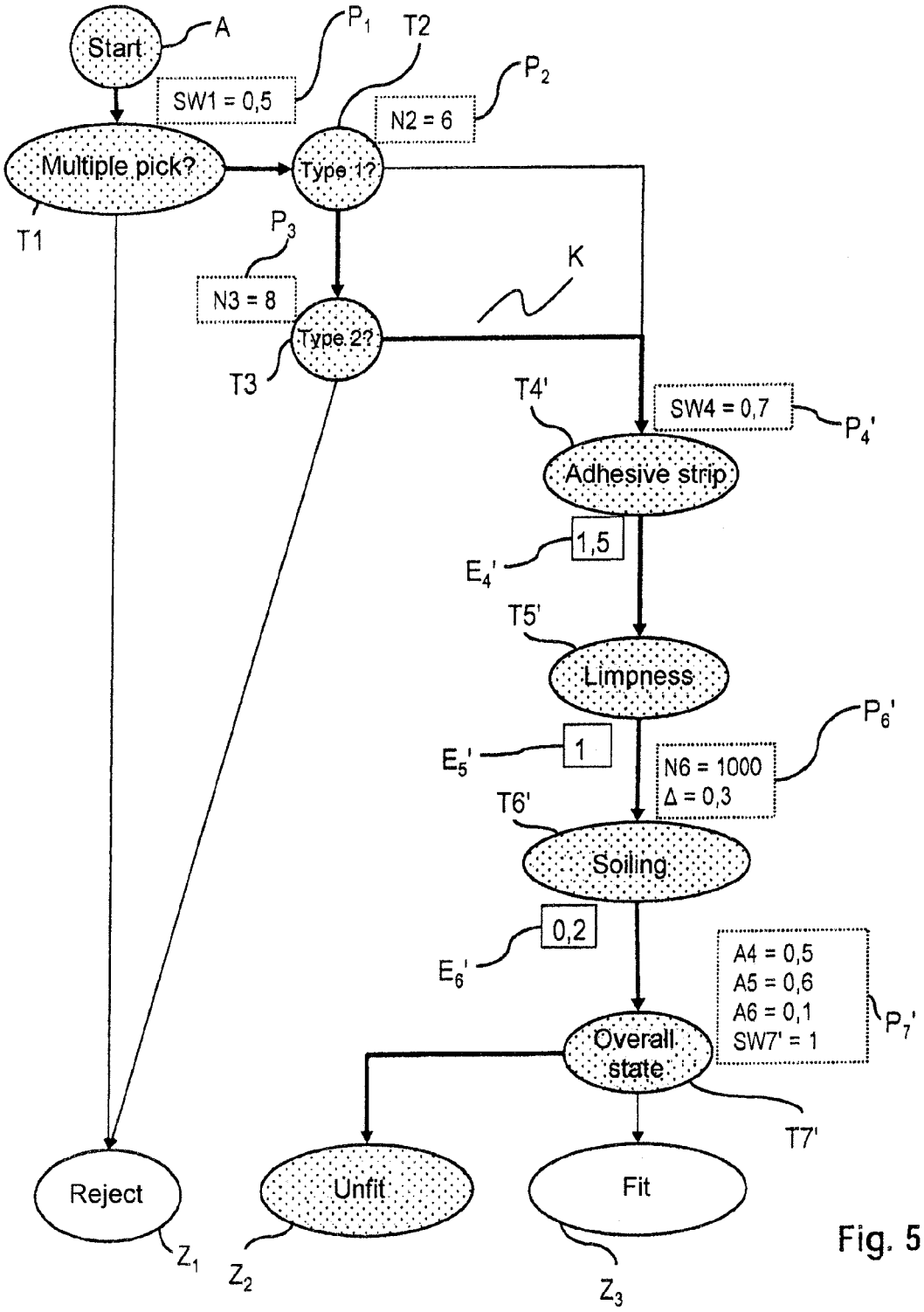

The data processing device 48 then so actuates the display device 46 that a graph is displayed as is sketched in FIG. 5 for the sensor data of the case in FIG. 3.

Figure 6:
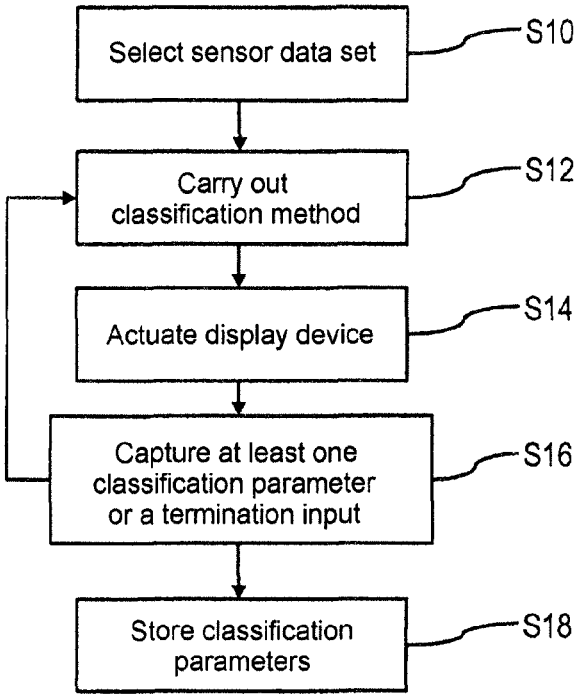

A fourth embodiment example of a method for establishing a sorting result, which is sketched in FIG. 6, differs from the first embodiment example in that after step S14 steps S16 and S18 are executed. The computer program stored in the data processing device 48 is modified accordingly.

In the step S16, the data processing device 48 captures input signals from the input device 47, i.e. keyboard 47.1 and/or pointing device 47.2, which represent a user's inputs which represent either at least one changed classification parameter or a confirmation that the changed classification parameters are to be stored. In the former case, the most recently valid classification parameters are updated in accordance with the inputs, and the method is continued with step S12.

If a confirmation is captured, however, the current classification parameters are stored in step S18.

This embodiment example allows an interactive adapting of classification parameters.

In other embodiment examples, substeps can be subdivided into a plurality of substeps to enable the coming about of the result to be reconstructed better.

Other embodiment examples differ from the above-depicted embodiment examples in that the display device is so actuated that the edges on the path from the starting node to the result node are marked not by another stroke thickness, but by another color.

Yet other embodiment examples differ from the above-depicted embodiment examples in that the carrying out of the classification method and the actuating of the display device are interlaced in such a way that after a substep is carried out the display device is so actuated that it displays the current status of the run of the classification method, as in the above-described embodiment examples, and continues with the next substep after a continuation signal from the input device that represents a user's wish to continue is captured.

Yet other embodiment examples can differ from the above-described embodiment examples in that, depending on the employed data processing device and computer program, substeps that can be executed independently of each other, e.g. the substeps T4' to T6' in the fourth embodiment example, are carried out at least partly in parallel. The path from the starting node A to the result node can then have parallel extending portions. The latter are characterized in that they begin at a common node for a substep and end at a common node for a substep and respectively have at least one different substep node.

Yet further embodiment examples differ from the above-described embodiment examples in that the system for establishing a sorting result for a value document while employing sensor data for the value document, in particular the data processing device, is not part of the value-document processing device but rather a device separate therefrom.

Figure 7:
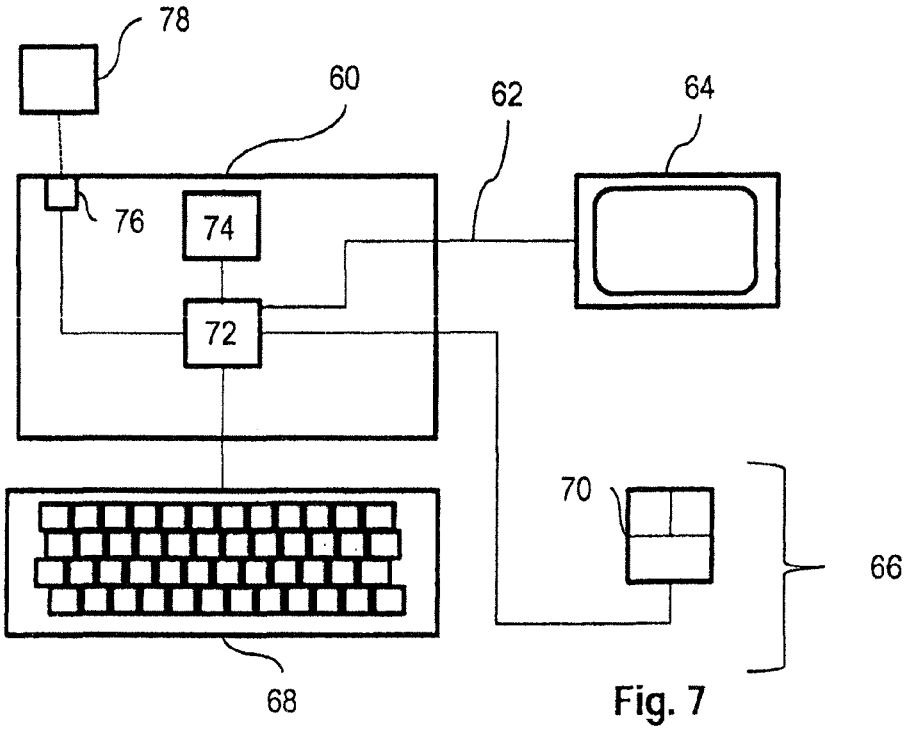

Such a system in FIG. 7 comprises a data processing device 60, a display device 64 connected to the data processing device 60 via a signal connection 62 and actuatable thereby, and an input device 66 likewise connected to the data processing device via at least one signal connection.

The display device 64, for example an LCD display or LCD monitor, is actuated by the data processing device 60, so that it displays contents determined by data processing device 60. As a signal connection connecting the display device 64 to the data processing device there can be used any suitable connection, for example a cable.

The input device 66 serves for capturing a user's inputs and possesses for this purpose, according to the first embodiment example, in this embodiment example a keyboard 68 and a pointing device 70, in the example a mouse, by means of which and the data processing device 60 a pointer is representable on the display device 64. Both the keyboard 68 and the pointing device 70 are connected via signal connections, in this example cable-type USB connections, to the data processing device 60, so that the latter can capture signals corresponding to a user's inputs.

The data processing device 60 comprises, inter alia, at least one processor 72 with an appurtenant main storage (not shown) and a storage device 74. The storage device 74 can comprise in particular a permanent storage, for example a hard disk, and working storage.

The data processing device 60 further has an interface 76 connected to the at least one processor via a signal connection, to which interface an external storage device 78, for example an external computer or server, is connectable via a signal connection suitable for the interface. In this embodiment example, the interface 78 is a network card by means of which a value-document processing apparatus is connected to the data processing device 60 via a LAN connection, so that sensor data for a value document are transferable to the data processing device 60 and storable there for employment in the storage device 74.

In the storage device 74, in this example more precisely the permanent storage, there is stored, inter alia, a computer program upon whose processing by the data processing device 60, more precisely the at least one processor 72, one of the above-described methods for establishing a sorting result is executed. The sensor data, classification parameters and identifier for a respective value document are then not read out of the measurement-value storage 56 upon the carrying out of the method, but rather out of the storage device 74.

Yet further embodiment examples differ from the above-depicted embodiment examples in that for the carried out substeps the data respectively employed upon their carrying out are stored in a storage device.

The invention claimed is:

1. A method for establishing a sorting result for a value document while employing sensor data for the value document which are capturable or were captured by means of a value-document processing apparatus with one or a plurality of sensors, and while employing pre-specified classification parameters, comprising carrying out a pre-specified classification method wherein the sensor data and at least one of the classification parameters are used and pre-specified substeps are carried out, at least some of said substeps containing the making of a respective decision, and after carrying out the substeps a class is established as a sorting result, wherein at least when making the decisions at least one classification parameter associated with the respective decision and/or at least part of the sensor data and/or at least one substep result that was obtained upon carrying out a preceding substep is respectively employed, and wherein for the established sorting result a display device is so actuated that it shows at least a section of a graph illustrating the course of the classification method and having nodes and edges respectively connecting at least two of the nodes, wherein the nodes comprise a starting node, at least one substep node representing one of said substeps necessary for obtaining the sorting result, and at least one result node representing a possible sorting result, and wherein the edges connect the nodes in such a way that the nodes connected by said edges represent a sequence, given by the classification method, of substeps represented by the nodes, and wherein those edges are marked that form a continuous path from the starting node to the result node representing the sorting result, said path representing the course of the classification method for the sensor data, and/or wherein as edges only those edges are shown that form a continuous path from the starting node to the result node representing the sorting result, said path representing the course of the classification method for the sensor data, and/or wherein those nodes are marked that are directly connected by edges which form a continuous path from the starting node to the result node representing the sorting result, said path representing the course of the classification method for the sensor data.

2. The method according to claim 1, wherein the classification method is capable of being carried out on the value-document processing apparatus.

3. The method according to claim 1, which is carried out on a value-document processing apparatus which comprises the display device.

4. The method according to claim 1, which is executed on a data processing device which has the display device.

5. The method according to claim 1, wherein the display device is so actuated that at least the classification parameters employed for establishing the sorting result are displayed, wherein the classification parameters employed upon the execution of the substep corresponding to the node are preferably displayed at the nodes of the path.

6. The method according to claim 1, wherein the display device is so actuated that adjacent to at least one of the substep nodes the result of the carrying out of the substep represented by the substep node is displayed.

7. The method according to claim 1, wherein the display device is so actuated that the marked edges or the marked nodes are marked in color.

8. The method according to claim 1, wherein the display device is so actuated that marked edges are displayed with a pre-specified line shape which differs from the line shape employed for displaying other edges or from the line shapes employed for displaying other edges.

9. The method according to claim 1, wherein only those nodes are displayed that lie in the continuous path.

10. The method according to claim 1, wherein only those edges are displayed that lie in the continuous path.

11. The method according to claim 1, wherein the display device is so actuated that the display is updated after the carrying out of one substep in each case or of a pre-specified number of substeps in each case, so that the part of the path is represented that corresponds to the hitherto carried out substeps, wherein the mode of display of the part of the path preferably corresponds to the mode of display of the path.

12. The method according to claim 1, wherein after termination of the classification method for the sensor data for the value document at least one user input is captured, and when the latter represents a value for one of the classification parameters said value for the classification parameter is stored, and the classification method with the then present classification parameters, and the actuating of the display device, are carried out.

13. The method according to claim 1, wherein for at least one of the carried out substeps the data employed upon its carrying out are stored in a storage device.

14. A computer program with program code upon whose execution by means of a data processing device which has a display device, the method according to claim 1 is executed.

15. A physical data carrier on which a computer program according to claim 14 is stored.

16. A system for establishing a sorting result for a value document while employing sensor data for the value document which are capturable or were captured by means of a value-document processing apparatus with one or a plurality of sensors, and while employing pre-specified classification parameters, having a data processing apparatus and having a display device, wherein the data processing device comprises at least one processor and a storage in which a computer program according to claim 14 is stored which is executable by means of the data processing device, wherein the at least one processor actuates the display device.

17. An apparatus for processing value documents, having a feeding device for feeding single or singled value documents to be processed, an output device having at least one output portion for receiving processed value documents, a transport device for transporting single or singled value documents from the feeding device to the output device, a sensor device for capturing sensor data for a value document transported by the transport device, and a system according to claim 16 for processing the captured sensor data which is connected to the sensor device via a signal connection.

* * * * *